US007152247B2

(12) United States Patent
Parsons

(10) Patent No.: US 7,152,247 B2
(45) Date of Patent: Dec. 26, 2006

(54) TACTICAL JACKET FOR A POLICE OFFICER

(75) Inventor: Kevin L. Parsons, Appleton, WI (US)

(73) Assignee: Armament Systems and Procedures, Inc., Appleton, WI (US)

( * ) Notice: Subject to any disclaimer, the term of this patent is extended or adjusted under 35 U.S.C. 154(b) by 248 days.

(21) Appl. No.: 10/625,377

(22) Filed: Jul. 23, 2003

(65) Prior Publication Data

US 2005/0015844 A1 Jan. 27, 2005

(51) Int. Cl.
*A41D 1/02* (2006.01)

(52) U.S. Cl. ..... 2/94; 2/247; 2/251; 2/253

(58) Field of Classification Search ..... 2/93, 2/94, 96, 102, 108, 247–254, 455, 456, 463, 2/2.5, 70, 85, 86, 115, 114
See application file for complete search history.

(56) References Cited

U.S. PATENT DOCUMENTS 1,520,962 A * 12/1924 North ..... 2/102
1,708,786 A * 4/1929 Cohen ..... 2/247
1,773,442 A * 8/1930 Speh ..... 2/94
2,150,251 A * 3/1939 Shanhouse ..... 2/94
2,375,652 A * 5/1945 Hess ..... 2/253
2,495,582 A * 1/1950 Henderson ..... 2/94
3,738,367 A * 6/1973 Hardy ..... 607/104
4,637,075 A * 1/1987 Ingrisano et al. ..... 2/94
5,195,187 A * 3/1993 Yang ..... 2/102
5,603,646 A * 2/1997 Tobias ..... 441/94
5,692,237 A * 12/1997 Bennett ..... 2/93
5,718,000 A * 2/1998 Ost et al. ..... 2/69
5,909,802 A * 6/1999 Puco et al. ..... 2/102
5,940,883 A * 8/1999 Daoust ..... 2/102
6,237,152 B1 * 5/2001 Gootrad ..... 2/87
6,314,579 B1 * 11/2001 Marcon ..... 2/102

* cited by examiner

*Primary Examiner*—A. Vanatta
(74) *Attorney, Agent, or Firm*—Jon P. Christensen; Welsh & Katz, Ltd.

(57) ABSTRACT

A jacket is provided for a law-enforcement officer. The jacket includes a plurality of receptacles adapted to receive police equipment disposed within a secure area of the jacket and a closure disposed on each of the plurality of pockets having an orientation so that only a single hand of the law-enforcement officer is required to open each of the closures.

13 Claims, 4 Drawing Sheets

TACTICAL JACKET FOR A POLICE OFFICER

FIELD OF THE INVENTION

The field of the invention relates to jackets and more particularly to jackets worn by police officers and police trainers.

BACKGROUND OF THE INVENTION

Police officers are typically required to carry a great deal of equipment in the performance of his/her duties. In addition to a gun, a police officer is often required to carry a radio, handcuffs, baton and a flashlight. Other equipment may include ticket books, tear gas, extra ammunition, or spare batteries for the radio.

Police trainers must also carry a large amount of equipment that may need to be available at all times for instructional purposes, use in simulations and in the event of injuries. A great deal of tactical training is done outside or on location. Trainers thus must carry and have on their person (when away from a typical classroom), Red Gun brand simulated training weapons, inert pepper spray, handcuffs, disposable restraints, restraint cutters, various sizes of expandable batons, a flashlight, pocket training books, pens, note pads and first aid equipment.

A great deal of the equipment carried by a police officer or police trainer is carried on the officer's or trainer's belt. Handguns have typically been carried in a gun holster attached to a belt. Tear gas containers and ammunition are also usually placed in special receptacles attached to the officer's or trainer's belt.

One difficulty with the conventional method of carrying such equipment is access. For example during inclement weather, the officer or trainer may wear a coat that covers and restricts access to the equipment carried by an officer or trainer. While this may be a minor inconvenience in some cases, it can become life-threatening in other cases. For example, when confronted by a weapon-wielding attacker, any delay in drawing the officer's weapon could place the officer in great danger.

As an alternative to carrying his equipment on the belt, an officer or trainer could place some of this equipment in the pockets of any coat that will be worn. However, the pockets of conventional coats are not particularly well suited for police equipment.

For example, an officer or trainer may choose to place a gun in the coat's pocket. However, if an officer should be seated, then a gun placed in a coat's pocket could fall out.

Further, if the officer or trainer is sitting on a cushioned seat, such as a car seat or a couch, and does not realize the gun has fallen out, then it may be some time before the officer or trainer realizes that the gun has been lost. In addition to the danger to the officer in not being armed when he believes that he is in fact armed, there is also a danger to anyone finding the lost gun, such as children or criminals.

In addition to the difficulty of coat pockets not being particularly well suited to carrying police equipment, there is also the difficulty of quickly extracting such equipment during an emergency. Guns in particular often have projections (e.g., the gun sight) that often snags on adjacent material. Because of the need for a police officer or police trainer to have ready access to his equipment, a need exists for a better method for carrying police equipment.

SUMMARY

A jacket is provided for a law-enforcement officer or trainer. The jacket includes a plurality of receptacles adapted to receive police equipment disposed within a secure area of the jacket and a closure disposed on each of the plurality of pockets with an orientation so that only a single hand of the law-enforcement officer or trainer is required to open each of the closures.

DETAILED DESCRIPTION OF A PREFERRED EMBODIMENT

Figure 1:
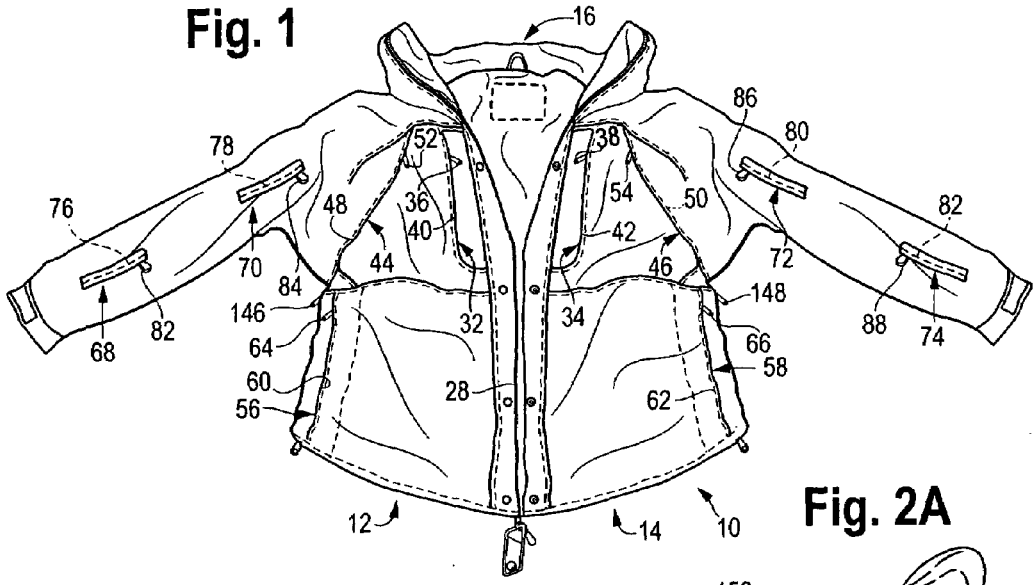
FIG. 1 depicts a front view of a jacket for law enforcement personnel in accordance with an illustrated embodiment of the invention.
Figure 2A:
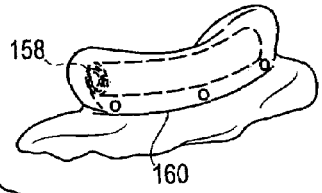
FIG. 2 depicts a rear view of a jacket of FIG. 1.
Figure 2:
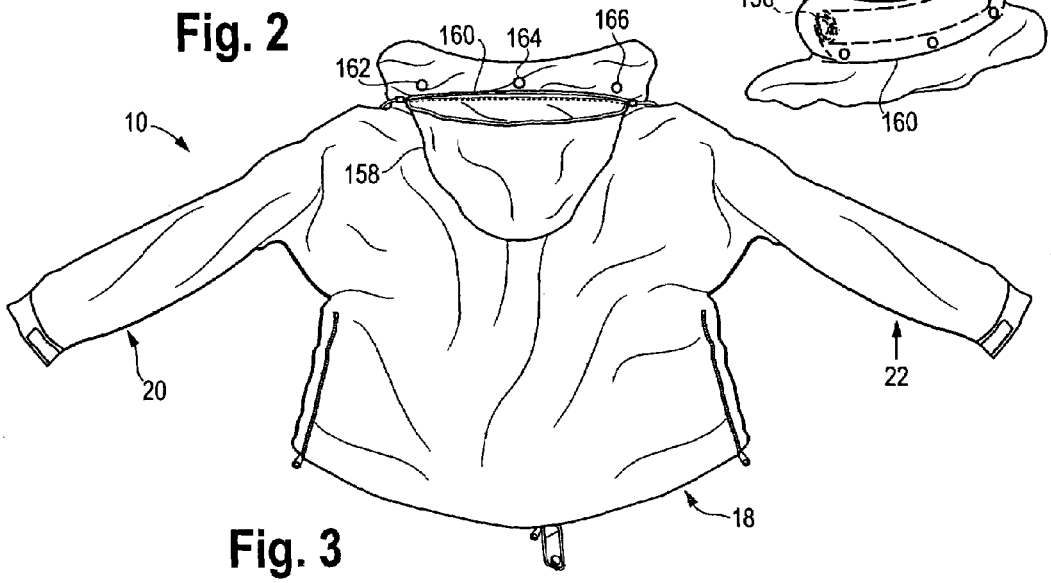
Figure 3:
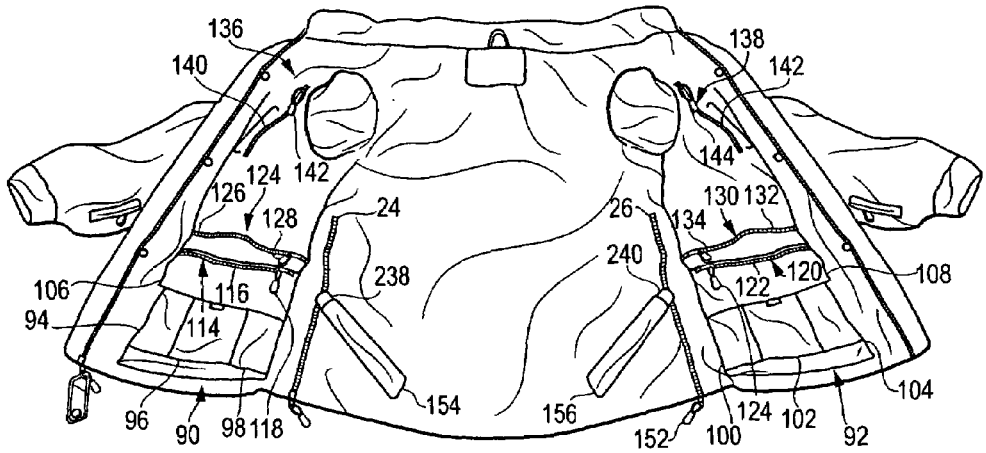
FIG. 3 depicts an inside view of the jacket of FIG. 1.

FIGS. 1 and 2 are front and rear views of a police tactical jacket 10 shown generally under an illustrated embodiment of the invention. FIG. 3 is an inside view of the jacket 10 of FIGS. 1 and 2. Under the illustrated embodiment, the jacket 10 may contain a number of receptacles for police equipment, which are adapted to the needs of the police officer or police trainer and to the security of the equipment involved.

Figure 4:
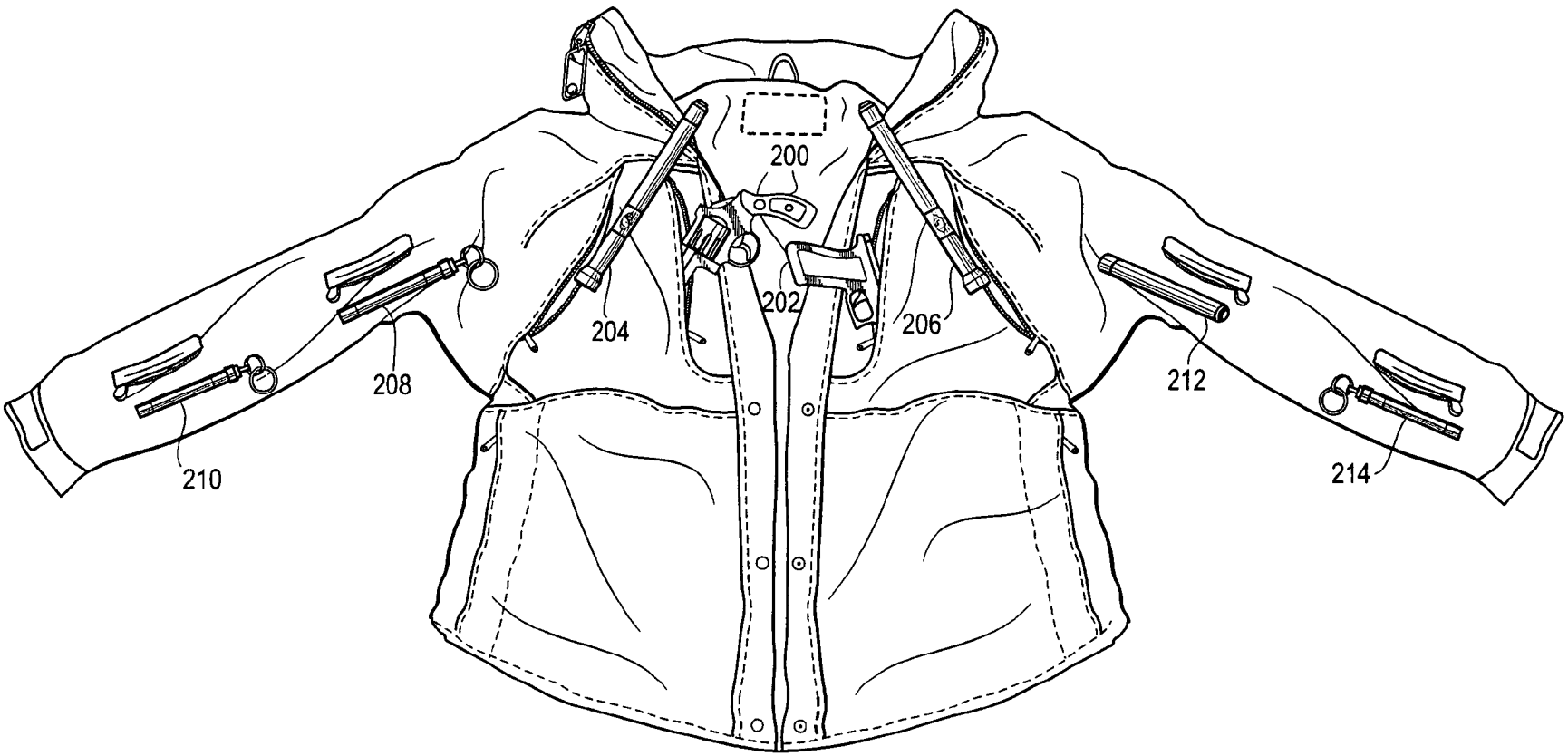
FIG. 4 depicts the jacket of FIG. 1 overlaid with police equipment that may be held by the jacket.
Figure 5:
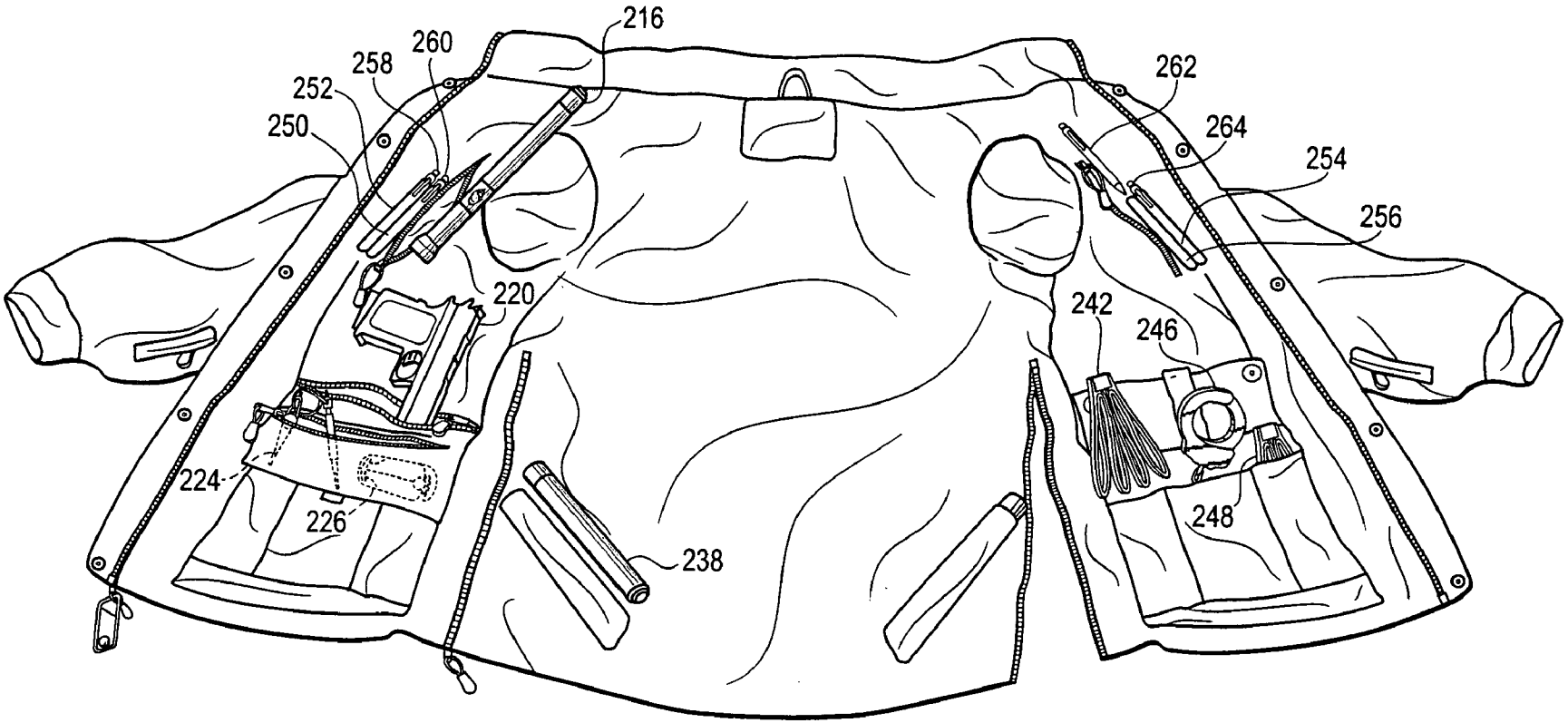
FIG. 5 depicts an inside view of the jacket of FIG. 1 overlaid with a portion of the police equipment that may be held by the jacket.
Figure 6:
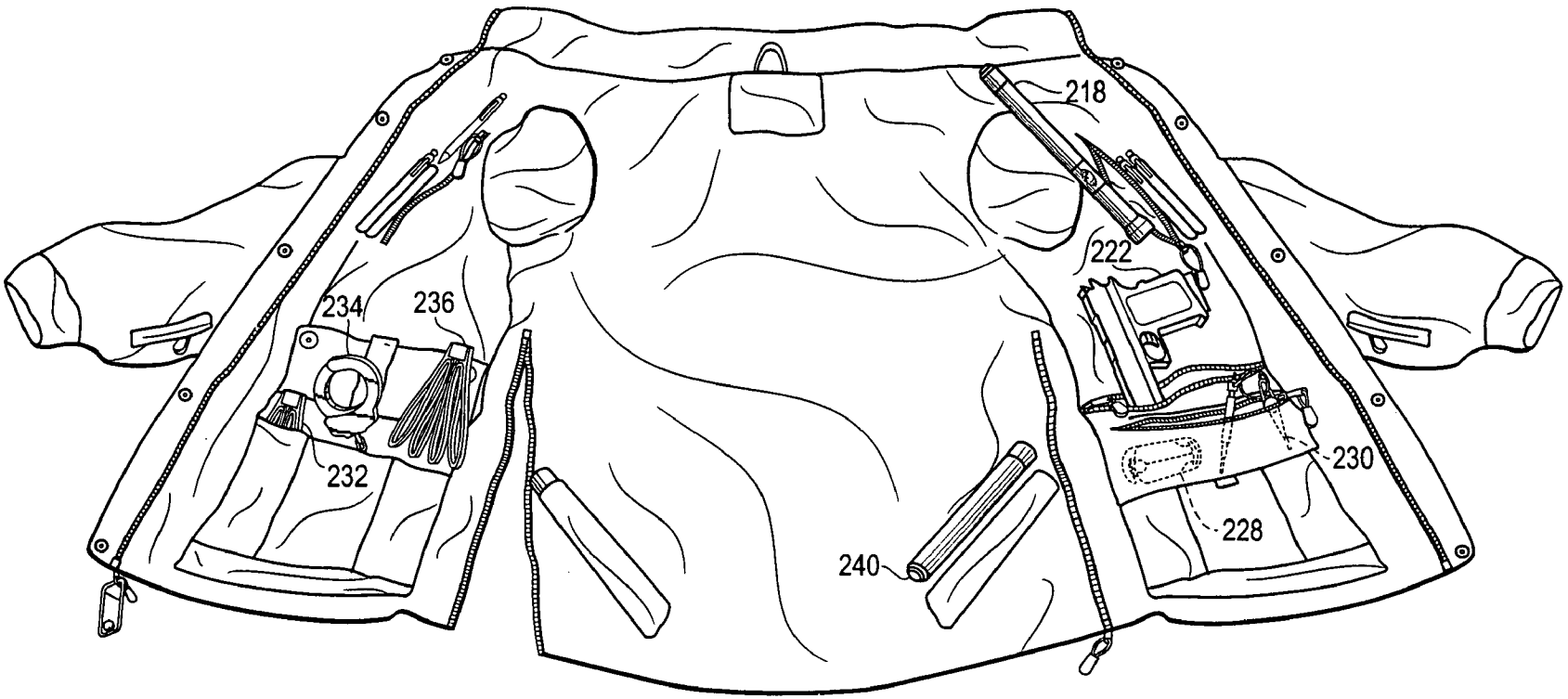
FIG. 6 depicts an inside view of the jacket of FIG. 1 overlaid with another portion of the police equipment that may be held by the jacket.

FIGS. 4, 5 and 6 show the jacket 10 of FIGS. 1, 2 and 3 with various types of police equipment overlaid on the jacket 10 proximate a receptacle that may be used to hold the equipment. Reference shall be made to FIGS. 4, 5 and 6 as appropriate to an understanding of the invention.

References made herein to upper and lower portions of the jacket refer to portions of the jacket that would be on an upper or lower portion of the jacket while being worn by a user when the user is standing. Similarly, a reference to an inside surface of the jacket refers to a side of the jacket that is normally in contact with the wearer.

To secure the police equipment involved against unauthorized use, a number of levels of security may be provided. At a first level, a unique closure arrangement may be provided to secure each receptacle against the accidental loss of equipment, yet provide quick access to the equipment by the police officer or police trainer. At another level, the jacket 10 may constructed to completely enclose and not provide any indication of the police equipment carried within the jacket 10.

Another level of security may be provided by limiting high-risk police equipment (e.g., guns) to secure area of the jacket 10. As used herein, a secure area of the jacket 10 is an area that is in the direct line-of-sight of the officer, and which is easily protectable by the arms of the officer. A secure area may also be an area that is inside the jacket 10.

If the officer should choose to reveal a firearm carried in a holster supported by a belt directly attached to the body of the officer, then the officer may open a side-access closure (e.g., a zipper) 24, 26 that lies beneath the arms of the jacket 10 from a bottom edge of the jacket 10, to reveal the officer's sidearm. In this case, opposing sides of the zipper would be disposed along opposing vertical sides of the sidearm, thus allowing easy access to the sidearm.

Alternatively, firearms and other important police equipment that require quick access may be carried within one or more receptacles (pockets) within the jacket 10. The pockets for firearms or other important police equipment may be adapted for the environment with a closure (e.g. a zipper) in a particular orientation that facilitates access by a police officer or police trainer using only a single hand.

A closure adapted so that only a single hand of the law enforcement officer is required to open the pocket means that the closure is oriented so that the force on the closure handle required to open the closure is directly transferred to the body of the wearer without distortion (i.e., wrinkling or bunching) of the closure or of the jacket body. This means that the officer does not have to hold the closure with one hand while he opens the closure with his other hand.

While the prior art has used front zippers for jackets that would inherently involve one-hand operation to open the jacket, the concept has been only randomly applied to the pockets on a jacket. In particular, the design of pocket closures has been directed more to aesthetic considerations than to efficiency or to the quickness in access to a jacket's pockets.

The problem of quick access to police equipment within a jacket has not been recognized because, in the past, most police equipment was carried on an officer's belt, which by itself provided quick access. The inherent problem with a belt however, is that the equipment is also in easy view of criminals, and is subject to inclement weather. In any struggle with a police officer, the visibility of the equipment makes such equipment an attractive target for an attacker.

One objective in the design of the jacket 10 is to reduce the visibility of police equipment, yet still provide quick access to the equipment by the police officer. The reduced visibility of the police equipment makes it less likely that an officer's equipment would be turned against the officer because the attacker would not know precisely where the equipment is or how to access it.

In this regard, it would be understood that the officer would have much more time to close the receptacles containing his equipment at a beginning of a work shift than he would have to open those receptacles during a police action. Accordingly, the receptacles described herein have been specifically designed for one-hand operation in opening those receptacles.

Turning first to the jacket 10, a description will be provided first of the body of the jacket 10. Once the body of the jacket has been described, a description will be provided of the various receptacles provided within the body.

In general, the body of the jacket 10 may be constructed of a heavy duty nylon or other suitable material that includes a pair of front panels 12, 14 joined by a neck portion 16 that passes around the back of the neck of the user. The body may also include a back panel 18 and a pair of sleeves 20, 22. The sleeves 20, 22 may be permanently attached to the respective front panel 12, 14 and back panel 18 in the shoulder area.

A conventional front zipper 28 may be provided to separably join the pair of front panels 12, 14. Consistent with the one-handed use of the jacket 10, when the zipper 24 is closed, a zipper control handle 30 is disposed adjacent the neck of the user. To open the zipper 28, the user simply grasps the handle 30 in one hand and pulls downward. The downward force on the zipper handle 30 is transferred from the top of the zipper 28 through the neck portion 16 to the neck of the user.

The neck portion 16 may also include a hood 158 and hood receptacle 160. The hood 158 may stored by rolling the hood along an axis that is parallel to the neck portion 16 and pushing the hood 158 inside a hood cover 160. The hood cover 160 may be secured to the neck portion 16 over the rolled-up hood 158 by a number of snap buttons 162, 164, 166.

As with other areas of the jacket 10, the hood 158 is adapted to be released by a single hand of the wearer. In this case, the wearer simply reaches over his head, grasps the hood cover 160 and pulls upwards, thereby releasing the hood 158.

Turning now to the receptacles for police equipment, a first and second receptacle (pocket) 32, 34 may be provided with access through an outside upper portion of the front panels 12, 14. The pockets 32, 34 may be secured by an appropriate closure (e.g., a zipper) 40, 42. Consistent with one-hand operation, in a closed position, a control handle 36, 38 of the zipper 40, 42 is disposed adjacent the neck of the wearer of the jacket 10. To open, the wearer simply grasps the handle 36, 38 in one hand and pulls downward. The downward force on the handle 36, 38 is transferred through the zipper 40, 42 and neck portion 16, to the neck of the wearer.

The receptacles 32, 34 may be adapted for use with a handgun 200, 202 (FIG. 4). Consistent with this adaptation, the zippers 40, 42 may be approximately 7 inches long to allow insertion of the handgun 200, 202. To further facilitate quick recovery of the gun, the pockets 32, 34 may extend downward from a bottom of the zipper 40, 42 and may be provided with a tapered bottom. The tapered bottom functions to retain a barrel of the gun in a downward direction, thereby assuring that the handle of the gun is always readily available adjacent the opening provided by the zipper 40, 42.

In use, the receptacles 32, 34 are disposed high on the chest of the wearer of the jacket 10. The location of the receptacles 32, 34, that is, high on the front of the officer's chest, renders taking the officer's gun by surprise extremely difficult, and certainly more difficult than grabbing the officer's gun from a hip-mounted holster that would be out of the direct line-of-sight of the officer. Further, the placing of the receptacles 32, 34 between the arms of the wearer also places the receptacles 32, 34 in an area where the strength of the officer's arms would be most effective in fighting off any attacker.

In addition, the placement of the receptacles 32, 34 high on the chest allows the retrieval of the handgun in close quarters with less likelihood of the police officer being disarmed from behind. Retrieval may be accomplished by the quick and simple two-step process of pulling the zipper down with one hand and retrieving the weapon with that same hand. Further, where a weapon is carried on each receptacle 32, 34, retrieval of a weapon may be accomplished by either hand.

A second set of receptacles (pockets) 44, 46 for police equipment may be provided on an outside surface near an upper marginal edge of the panels 12, 14 adjacent a shoulder portion of the jacket 10. The pockets 44, 46 may be secured by another appropriate closure (e.g, a zipper) 48, 50. Consistent with one-hand operation, in a closed position, a handle 52, 54 of the zipper 48, 50 is disposed adjacent the neck of the wearer of the jacket 10. To open, the wearer grasps the handle 52, 54 in one hand and pulls downward. The downward force on the handle 52, 54 is transferred through the zipper 48, 50 and neck portion 16, to the neck of the wearer.

The receptacles 44, 46 may also be adapted for use with a police baton 204, 206. Consistent with this adaptation, the zippers 48, 50 may be approximately 7 inches long to allow for insertion of the baton. To further facilitate quick recovery of the baton 204, 206, the pockets 44, 46 may extend downward with a tubular shape from a bottom of the zipper 48, 50 to the bottom of the pocket 44, 46. The tubular shape functions to retain a handle of the baton 204, 206 at the top of the pocket 44, 46, thereby assuring that the handle of the baton 204, 206 is always readily available adjacent the opening provided by the zipper 48, 50.

The placement of the second set of receptacles 44, 46 in the upper chest region also functions to place the receptacles 44, 46 in a region that can be best protected by the strength of the officer's arms. Further, the placement of the receptacles 44, 46 on the upper chest adjacent a firearm allows the officer to choose a measured response appropriate to the situation. For example, during a physical encounter in a crowded environment, an officer would be more likely to choose a baton rather than a gun. Further, the availability of an option increases the effectiveness of an officer in a situation when the officer may be outnumbered or may be faced with a physically stronger opponent.

Also provided along a left and right marginal edge of the front panels 12, 14 are a set of conventional pockets 56, 58. Conventional pockets 56, 58 would be considered to be a less significant part of the inventive aspects of the jacket 10 because they lie in an area of the jacket 10 that is not secure. The pockets 56, 58 are not secure because they lie on a part of the jacket 10 that is out of the direct line-of-sight of the officer and are difficult for the officer to defend with both arms.

The pockets 56, 58 may be secured through the use of a zipper 60, 62. As with the other receptacles of the jacket 10, the zippers 60, 62 may be provided with control handles 64, 66 adapted for one-hand use. With the zipper closed, a handle 64, 66 resides at an upper end of the zipper 60, 62. To open the zipper 60, 62, the user grasps the handle 64, 66 and pulls downward. Consistent with the one-hand operation of the jacket 10, the downward force exerted on the zipper handle 64, 66 is transferred through the zipper and panel 12, 14 to the neck portion 16, and to the neck of the wearer.

The zippers 60, 62 allow the conventional pockets 56, 58 to be optionally used for storing police equipment, but would be more likely used by the wearer for personal items (e.g., gloves) or for warming the hands of the wearer. In this regard, the pockets 56, 58 may be fleece lined.

Another less conventional set of receptacles accessible from an outside of the jacket 10 may be represented by pockets 154, 156 (FIG. 3) that may be adapted for use with a set of batons 238, 240. In this case, a closure may be provided by the side access zippers 24, 26. The zippers 24, 26 have been previously described as providing access to a sidearm worn on a belt underneath the jacket 10.

In this situation for access to the pockets 154, 156, the side zippers 24, 26 are used somewhat differently. In general, the side zippers 24, 26 are provided with zipper control handles 146, 148, 150, 152 on opposing ends of the zippers 24, 26. If the wearer of the jacket 10 should wish to expose a sidearm worn on a belt, then the wearer pulls upon one or both of the lower zipper control handles 150, 152 from the bottom.

On the other hand, if the wearer wishes to gain access to a baton 238, 240 disposed within the pockets 154, 156, then the wearer may pull down the control handles 146, 148 from the top of the zipper 24, 26. One-handed operation of the zipper 24, 26 is ensured because a force exerted on the zipper handle 146, 148 is transferred through the zipper and sleeve 20, 22 into the shoulder of the wearer.

Once the zipper 24, 26 has been opened with a single hand, the wearer may then reach inside with that same hand, grasp a baton 238, 240 and employ the baton 238, 240 with one quick motion. The one-handed operation of the zipper 24, 26 allows the officer to fend off an attacker with one hand while he retrieves a baton with the other hand. The presence of a baton on each side allows the officer to retrieve a baton with either hand. While the zippers 24, 26 are in the closed position, the zippers 24, 26 provide security for the officer because with the zipper closed, any attacker would not know that the batons are there.

Other receptacles (pockets) 68, 70, 72, 74 may be distributed along a length of and on a top surface of each arm 20, 22. Since these receptacles 68, 70, 72, 74 are on a top surface of the arms 20, 22 of the jacket 10, they would be less secure because it would be more difficult for the officer to defend these receptacles 68, 70, 72, 74 with both arms. However, since the receptacles 68, 70, 72, 74 are still within the line-of-sight of the officer, the receptacles 68, 70, 72, 74 may still be used for a less lethal class of police equipment.

As with the other receptacles, the arm pockets 68, 70, 72, 74 may be secured with a zipper 76, 78, 80, 82 that is disposed parallel to the arm 20, 22. Consistent with one-hand operation, in a closed position, a handle 82, 84, 86, 88 of the zippers 76, 78, 80, 82 is disposed on an end of the zipper 76, 78, 80, 82 nearest the neck of the wearer of the jacket 10. To open, the wearer simply grasps the handle 82, 84, 86, 88 in one hand and pulls downward (away from the neck of the wearer). The downward force on the handle 82, 84, 86, 88 is transferred through the zipper 76, 78, 80, 82 and neck portion 16, to the neck of the wearer.

The receptacles 68, 70, 72, 74 may also be adapted for use with canisters of an incapacitating spray or aerosol(e.g., tear gas, MACE brand of chemical irritant spray manufactured by Mace Security International (MSI), pepper spray, and the like) 208, 210, 212, 214. Consistent with this adaptation, the zippers 48, 50 may be approximately 5 inches long to allow insertion of the incapacitating spray canister 208, 210, 212, 214. To further facilitate quick recovery of the canister 208, 210, 212, 214, the pockets 68, 70, 72, 74 may extend inwardly a short distance (e.g., 2 inches) from an edge of the zipper 76, 78, 80, 82 to form a shallow pocket that allows the length of the canister 208, 210, 212, 214 to lie parallel (and adjacent) to a length of the zipper 76, 78, 80, 82. The shallow pocket functions to hold the canister 208, 210, 212, 214 in a particular orientation that retains a control end of the canister 208, 210, 212, 214 near an opening end of the pocket 68, 70, 72, 74, thereby assuring that the user of the jacket 10 can quickly grasp the control end immediately after opening the pocket 68, 70, 72, 74.

The pockets 68, 70, 72, 74 also support the need of an officer to provide a measured response in terms of force. The presence of pockets 68, 70, 72, 74 on both arms allows the officer to hold a suspect with one hand while selecting an incapacitating agent with the other hand. The presence of multiple pockets 68, 70, 72, 74 allows for a range of incapacitating agents to be provided and selected for use by the officer.

An inside surface of the jacket 10 may also be provided with a number of receptacles. In general, the inside of the jacket 10 would be considered to be the most secure portions of the jacket, but is also the least accessible. As such, the inside of the jacket 10 may be reserved for backup police equipment.

Because of the backup nature of the equipment inside the jacket 10, at least some of the receptacles on the inside of the jacket are more complex than those on the outside. For example, a lower inside surface of each panel 12, 14 may each be provided with a suite of receptacles 90, 92 for prisoner restraint devices. The first suite of receptacles 90 may include three receptacles 94, 96, 98. The second suite of receptacles 92 may also include three receptacles 102, 104, 106.

A closure in the form of a flap 106, 108 may cover each suite of receptacles 90, 92. Each flap 106, 108 may be provided with angled edges (angled towards the center of the flap 106, 108) and be held closed by a dot snap in opposing corners. Consistent with one hand operation, the wearer of the jacket 10 may release the flap 106, 108 by grasping a corner of each flap 106, 108 (adjacent the dot snap) between the thumb and forefinger while pushing against the face of the suite of receptacles 90, 92 with the remainder of the fingers on the same hand.

As shown in FIGS. 5 and 6, the two outside pockets 94, 96, 100, 104 of each suite 90, 92 may be used to hold plastic handcuffs 232, 236, 242, 248. An inner pocket 96, 102 may be used to hold metal handcuffs.

Included on the flaps 106, 108 may be an additional receptacle 114, 120. A closure (e.g., a zipper) 116, 122 may be provided to secure the receptacle 114, 120.

In its closed position, a handle 118, 124 of the zipper 116, 118 may be disposed towards a back portion of the jacket 10 as shown in FIG. 3. To open the zipper 114, 120, the wearer may grasp the handle 118, 124 and pull it towards the front. Consistent with one-hand operation, the force on the handle 118, 124 is transferred through the zipper 114, 120, diagonally across the back panel 18 to the opposing arm of the wearer.

The pocket 114, 120 may be used to contain release devices for the prisoner restraint devices 232, 234, 236, 242, 246, 248. In this regard, the pocket 114, 120 may contain keys 224, 230 for metal handcuffs 234, 246 and a cutter 226, 228 for the plastic handcuffs 232, 236, 242, 248.

During use, the weight of the release devices 224, 230, 226, 228, the weight of the flap 106, 108 and the weight of the dot snaps together function to cause the flaps 106, 108 to fall into a closed position to re-secure any remaining restraint devices after a restraint device has been removed. Keeping the flaps 106, 108 in a closed position is useful in that it secures the restraint devices 232, 234, 236, 242, 246, 248 under an inside surface of the flaps 106, 108, thus preventing the restraint devices 232, 234, 236, 242, 246, 248 from falling out.

The center pocket 96, 102 may also be provided with a locking strap that separately prevents the handcuffs 234, 246 from falling out of the pocket 96, 102 even with the flap 106, 108 in a raised position. The locking strap extends from above the pocket 96, 102 over the handcuffs 234, 246 and is secured on a distal end of the strap to a top edge of the pocket 96, 102. The distal end may be secured to the top edge of the pocket by complementary hook and loop strips (e.g., Velcro) attached to respective sides of the strap/pocket interface.

Located above the pockets 114, 120 may be another set of receptacles (pockets) 124, 130. A closure (e.g., a zipper) 128, 132 may be provided along an upper marginal edge of the pocket.

In its closed position, a handle 128, 134 of the zipper 124, 130 may be disposed towards a back portion of the jacket 10 as shown in FIG. 3. To open the zipper 124, 130, the wearer may grasp the handle 128, 134 and pull towards the front. Consistent with one-hand operation, the force on the handle 128, 124 is transferred through the zipper 124, 130, diagonally across the back panel 18 to the respective arm of the wearer.

Located within the pockets 124, 130 may be backup handguns 220, 222. As with the above-described pockets for guns, the pockets 124, 130 may have tapered bottoms to ensure that the handle of the handgun 220, 222 are always oriented near the top of the pocket 124, 130.

Disposed on a top inside surface of the panels 12, 14 may be another set of receptacles (e.g., pockets) 136, 138. A closure (e.g, a zipper) 140, 142 along an outside marginal edge of the pocket 136, 138.

Each zipper 140, 142 may have a handle 142, 144 that is disposed along an upper end of zipper 140, 142 when the zipper 140, 142 is in the closed position. Consistent with one-handed operation, the wearer may grasp the handle 142, 144 and pull downward. The force from pulling the handle 142, 144 is transferred through the zipper through the neck portion 16, and to the neck of the wearer.

Contained within each of the pockets 136, 138 may be a baton 216, 218. Consistent with the shape of the baton 216, 218, the inside of the pocket 136, 138 may be tubular in shape and be of sufficient depth to hold a handle of the baton 216, 218 near an upper end of the aperture covered by the zipper 140, 142.

Also included adjacent the pockets 136, 138 may be a number of tubular receptacles 250, 252, 254, 256 disposed on an inner surface of the front panels 12, 14. The tubular receptacles 250, 252, 254, 256 may be used for writing instruments.

Even though the receptacles 90, 92, 114, 120, 136, 138 are inside the jacket 10, they are still designed for the overall ease of use by an officer using only one hand. For example, upon determining that the officer needs a set of handcuffs, the officer may unzip the jacket (if not already unzipped) using a single hand (as described above). Once the jacket 10 is unzipped, the officer may lift one of the flaps 106, 108 (again using a single hand) and remove an appropriate handcuff 232, 234, 236, 242, 246, 248 for use. The retrieval of a key 224, 230 or a cutter 226, 228 can be accomplished with similar ease.

If the officer should lose his primary handguns 200, 202, he may easily retrieve any of the secondary handguns 220, 222. In this case, the process may be accomplished as described above with a single hand.

Similarly, if the officer needs a secondary baton 216, 218, he may easily open the zipper 28 a short distance to retrieve the desired baton 216, 218. Retrieval of the writing instrument 258, 260, 262, 264 may be accomplished with similar ease.

In general, the jacket 10 functions to protect the officer from inclement weather while at the same time acts as a convenient and safe receptacle for police equipment. The appropriate use of pocket closures and the strategic placement of weapons receptacles enhances the security of the officer and the public in general. Although a police office is referred to herein as the user of the jacket 10, any suitable personnel may wear the jacket and obtain the advantages therefrom, such as any law-enforcement personnel, military personnel, para-military personnel, and the like.

A specific embodiment of a jacket for police equipment has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. A jacket for law-enforcement personnel comprising:

a plurality of pockets adapted to receive police equipment disposed within a secure area of the jacket;

a zippered closure disposed on each of the plurality of pockets with an orientation that extends generally downwards or away from a neck aperture of the jacket with a zipper of the zipped closure that opens the pocket by being pulled generally downwards or away from the neck aperture so that only a single hand of the user is required to open each of the closures;

a pair of front panels connected by a neck portion, a back panel and a pair of sleeves; and a side access zipper that joins a front panel of the pair of front panels and the back panel so that only a single hand of the user is required to open the side access zipper from an upper end.

2. The jacket as in claim 1 wherein the side access zipper further comprises a zipper control handle on a lower end that allows the zipper to be opened from a lower end.

3. The jacket as in claim 1 further comprising a pocket adapted to hold a baton proximate the side access zipper.

4. A jacket for a law-enforcement officer comprising:

a pair of front jacket panels connected by a neck portion;

a plurality of receptacles disposed on an inside surface of a first jacket panel of the pair of jacket panels, said plurality of receptacles being adapted to releasably receive police restraint devices; and a cover flap that falls into place to re-secure remaining restraint devices after a restraint device has been removed, said cover flap being coextensive with a set of openings of the plurality of receptacles and having an interior pocket inside the cover flap.

5. The jacket as in claim 4 wherein the plurality of receptacles adapted to receive the restraint devices further comprises a pocket adapted to releasably receive plastic handcuffs.

6. The jacket as in claim 4 wherein the plurality of receptacles adapted to receive restraint devices further comprises a pocket adapted to releasably receive metal handcuffs.

7. The jacket as in claim 4 wherein the plurality of receptacles adapted to releasably receive the restraint devices is on an end of one of the panels opposite the neck portion.

8. The jacket as in claim 4 wherein a receptacle of the plurality of receptacles adapted to receive the restraint devices further comprises a zippered pocket.

9. The jacket as in claim 4 further comprising a receptacle of the plurality of receptacles that is adapted to releasably receive a firearm on an inside surface of the second jacket panel of the pair of jacket panels.

10. The jacket as in claim 9 wherein the receptacle adapted for the firearm is on an end of one of the panels opposite the neck portion.

11. The jacket as in claim 4 further comprising a back panel joined on an upper edge to the neck portion and to the pair of front panels on opposing sides with a zipper.

12. The jacket as in claim 4 further comprising a receptacle for a baton on a lower edge of a back portion.

13. The jacket as in claim 4 further comprising a receptacle for a firearm on an upper end of one of the pair of panels.

* * * * *